US005389283A

United States Patent [19]

Held, III

[11] Patent Number: 5,389,283

[45] Date of Patent: Feb. 14, 1995

[54] SUBSTANTIALLY PHOSPHATE FREE MILDLY ACIDIC CLEANER FOR PLASTICS

[75] Inventor: Theodore D. Held, III, Grosse Pointe Farms, Mich.

[73] Assignee: Henkel Corporation, Plymouth Meeting, Pa.

[21] Appl. No.: 974,369

[22] Filed: Nov. 10, 1992

Related U.S. Application Data

[63] Continuation of Ser. No. 628,254, Dec. 14, 1990, abandoned.

[51] Int. Cl.[6] ..... C11D 1/04; C11D 1/22

[52] U.S. Cl. ..... 252/174.19; 252/106; 252/142; 252/559; 134/40

[58] Field of Search ..... 252/180, 142, 143, 106, 252/559, 174.19; 134/40, 42

[56] References Cited

U.S. PATENT DOCUMENTS

| | | | |
|---|---|---|---|
| 3,218,260 | 11/1965 | Lewandowski | 252/142 |
| 3,928,249 | 12/1975 | Nunziata et al. | 252/143 |
| 4,079,020 | 3/1978 | Mills et al. | 252/547 |
| 4,144,201 | 3/1979 | Wintertham et al. | 252/547 |
| 4,235,752 | 11/1980 | Rossall et al. | 252/551 |
| 4,247,408 | 1/1981 | Imamura et al. | 252/143 |
| 4,569,782 | 2/1986 | Disch et al. | 252/106 |
| 4,895,658 | 1/1990 | Amjad | 252/180 |

FOREIGN PATENT DOCUMENTS

| | | |
|---|---|---|
| 0213500 | 3/1987 | European Pat. Off. . |
| 0208177 | 3/1984 | German Dem. Rep. . |
| 0046736 | 11/1988 | Hungary . |
| 57-103494 | 6/1982 | Japan . |
| 57-105494 | 6/1982 | Japan . |
| 53-018606 | 2/1986 | Japan . |
| 61-118499 | 6/1986 | Japan . |
| 61-276899 | 12/1986 | Japan . |
| 62-004792 | 1/1987 | Japan . |
| 1487715 | 10/1977 | United Kingdom . |
| 0536221 | 3/1977 | U.S.S.R. . |

*Primary Examiner*—Paul Lieberman
*Assistant Examiner*—E. M. Higgins
*Attorney, Agent, or Firm*—Ernest G. Szoke; Wayne C. Jaeschke; Norvell E. Wisdom, Jr.

[57] ABSTRACT

An effective phosphate free and organic solvent free aqueous acidic cleaner for soiled plastic surfaces is an aqueous solution or dispersion that has a pH in the range from about 4.4—about 6.1; that has a buffering capacity sufficiently high that at least 0.06 milliequivalents of a strong alkali per liter of the composition must be added to raise the pH of the composition by 0.1 pH unit; and that consists essentially of water and:

(A) from about 0.4 to about 10 milliequivalents per kilogram of total composition ("mEq/kg") of acids selected from the group consisting of hydroxycarboxylic and dicarboxylic acids;

(B) from about 1.4 to about 20 mEq/kg of salts containing anions of acids selected from the group consisting of hydroxycarboxylic and dicarboxylic acids; and (C) from about 0.21 to about 3.3 grams per kilogram of total composition ("g/kg") of nonionic surfactant; and, optionally, (D) an amount of hydrotrope material that is from about 0.25 to about 0.75 times the amount in g/kg of component (C); and (E) a sufficient amount of biocidal material to inhibit growth of any bacteria and fungi that may be present in the composition.

14 Claims, No Drawings

SUBSTANTIALLY PHOSPHATE FREE MILDLY ACIDIC CLEANER FOR PLASTICS

CROSS-REFERENCE TO RELATED APPLICATION

This application is a continuation of application Ser. No. 628,254, filed Dec. 14, 1990, now abandoned.

BACKGROUND OF THE INVENTION

1. Field of the Invention

This invention relates to compositions and processes for cleaning engineering plastic surfaces. Surfaces that can be effectively cleaned according to this invention include, but are not limited to, polyester sheet molding compound ("SMC"); poly(vinyl chloride) ("PVC") homopolymers and copolymers; polyurethane and polyurea plastics such as those made commercially by injection molding; terpolymers of acrylonitrile, butadiene, and styrene ("ABS"); poly{phenylene oxide} ("PPO") and copolymers of "phenylene oxide" with other materials such as polyamides; polycarbonate ("PCO") polymers and copolymers; and thermoplastic polyolefins ("TPO"). The invention is particularly suited to cleaning plastics, more particularly SMC, that contain solid filler materials, especially those that are chemically alkaline, such as calcium carbonate. Common commercially available types of such SMC materials include PHASE ALPHA TM from Ashland Chemical Co., SL 1223 TM from Eagle Picher Co., Type 7113 TM from Gencorp, and RI 9486 TM from Rockwell International, Inc.

The compositions of the invention are substantially or entirely free from phosphate and can be substantially or entirely free from volatile organic solvents as well, and are therefore less polluting than the now common commercial acidic cleaners for plastics.

2. Statement of Related Art

Numerous compositions and processes for cleaning plastic surfaces are currently known in the art. Most of them include acid, surfactant(s), and phosphates. In some locations, however, phosphates are forbidden or severely limited to avoid potential pollution and eutrophication of bodies of water that receive discharges of industrial waste water. Thus, compositions that contain little or no phosphate but are still effective cleaners have been sought.

U.S. Pat. No. 4,895,658 according to an abstract thereof teaches compositions containing a weak organic acid and an acrylic polymer for cleaning semipermeable membranes, particularly cellulose acetate and triacetate, polyamide, and polysulfone membranes. Preferred weak acids are citric, malic, sulfamic, and mixtures of these.

Hungarian published accepted specification T046736 according to an abstract thereof teaches compositions including citric acid and a partially hydrogenated caprolactam oligomer as cleaning agents for ceramic cladding materials.

Published European patent application 0 213 500 according to an abstract thereof teaches liquid detergent compositions containing surfactants, an agent to retard redeposition of soil, and optionally a water soluble sequestrant builder that may be or include citrates.

Published Japanese application 62-004792 according to an abstract thereof teaches a cleaner for removing mold that comprises peroxides, phosphoric acid or phosphate salts, divalent cations, and lower carboxylic acids or salts thereof. Citric acid and citrates may constitute the latter ingredient.

Published Japanese application 61-276899 according to an abstract thereof teaches a cleaner for fiber reinforced plastic moldings. The cleaner is improved by adding to the "usual" ingredients, such as surfactant(s) and organic solvent(s), a dicarboxylic and/or hydroxycarboxylic acid, which may be citric acid.

Published Japanese application 61-118499 according to an abstract thereof teaches a spray cleaning composition for plastic articles. The composition comprises water insoluble inorganic powder and conventional surfactants and may also contain builders, defoaming agents, chelating agent, and solvent. Citric acid is taught as an example of a chelating agent.

Published East German patent application 208177 according to an abstract thereof teaches a composition containing citric acid, phosphate salt, wetting agent, and corrosion inhibitor as useful for cleaning metal or plastic surfaces from corrosive etching solutions or their reaction products.

Published Japanese application 57-105494 according to an abstract thereof teaches a detergent composition containing polyoxyethylene alkyl ether (a nonionic surfactant) and sodium citrate as its main components and optionally containing additional components. This composition is recommended for cleaning plastic sheets used in horticulture.

Published Japanese application 53-018606 according to an abstract thereof teaches a composition for cleaning metal, plastic, or glass. The necessary ingredients of the composition include lithium salts of an acidic partial ester of sulfuric acid, of a sulfonic acid, or of an alkanolamine. Citric acid is shown as an optional ingredient.

Patent publication 536221 from the U.S.S.R. according to an abstract thereof teaches an emulsifier for cleaning metal surfaces. The emulsifier contains oxyethylated alcohol; mono-, di-, or tri-ethylamino carbonate; disodium mono-, di-, or tri-ethylamino ethylenediaminetetraacetate or sodium tripolyphosphate; sodium citrate; and water.

British published patent application 1 487 715 according to an abstract thereof teaches a "universal" acidic cleaning product containing phosphoric acid, citric acid, and esters of phosphoric acid together with alkylaminopoly glycol ether surfactant and sufficient basic constituents to produce a pH of about 2.

DESCRIPTION OF THE INVENTION

Except in the claims and the operating examples, or where otherwise expressly indicated, all numbers in this description indicating amounts of material or conditions of reaction and/or use are to be understood as modified by the word "about" in describing the broadest scope of the invention. Practice within the exact numerical limits stated is generally preferred. Also, except when explicitly noted to the contrary, mixtures of different chemical entities all conforming to any general description given are to be understood as being as effective for the purposes of the invention as chemically pure compounds.

SUMMARY OF THE INVENTION

One embodiment of a composition according to this invention, specifically a composition suited for direct use as such in cleaning plastic surfaces, is an acidic aqueous liquid solution that has a pH in the range from 4.4–6.1, or more preferably in the range from 5.0–5.7; that has a buffering capacity sufficiently high that at least 0.06, or more preferably at least 0.23, milliequivalents of a strong alkali per liter of the composition must be added to raise the pH of the composition by 0.1 pH unit; and that comprises, or preferably consists essentially of, water and:

(A) from 0.4 to 10 milliequivalents per kilogram of the total composition ("mEq/kg"), preferably from 0.9 to 6 mEq/kg, or more preferably from 1.6 to 5.0 mEq/kg, of hydroxycarboxylic and/or dicarboxylic acid or acids;

(B) from 1.4 to 20 mEq/kg, preferably from 2.7 to 19 mEq/kg, or more preferably from 5.3–15.6 mEq/kg, of salts including anions of hydroxycarboxylic and/or dicarboxylic acid or acids, preferably anions of the same acid or acids as specified for part (A); and (C) from 0.21 to 3.3 grams per kilogram of total composition ("g/kg"), preferably from 0.4–3 g/kg, more preferably from 0.87–2.6 g/kg, of nonionic surfactant; and, optionally but preferably, (D) a sufficient amount of hydrotrope material to produce a stable homogeneous solution or dispersion of components (A) through (C) in water; and (E) a sufficient amount of a biocidal material to inhibit growth of any bacteria and/or fungi that may be present in the composition.

In this description, an equivalent of acid is to be understood as the amount that would provide one gram atom of hydrogen atoms upon complete ionization, and an equivalent of the salt of such an acid is to be understood as the amount of the salt that requires the replacement of some other cations with one gram atom of hydrogen ions to regenerate the free acid.

Within the broadest scope of the invention, any organic acid made up of molecules of which each contains at least one carboxyl group and at least one hydroxyl or additional carboxyl group may be used for ingredient (A) above. Thus, for example, gluconic acid, hydroxyacetic acid, succinic acid, fumaric acid, potassium acid phthalate, tartaric acid, malonic acid, and citric acid could all be used. Preferably, component (A) is made up of molecules with not more than six carbon atoms each and with at least three, or more preferably, at least four, total —OH and —COOH groups per molecule. The most preferred acid for ingredient (A) is citric acid.

Within the broadest scope of the invention, any conventional non-ionic surfactant that is water soluble or dispersible may be used for component (C). Preferred molecules for this component are generally those made by, or having a structure that could be made by, condensing fatty alcohols with suitable amounts of ethylene oxide, and optionally also with some propylene or other higher alkyl oxides, as generally known in the art.

A hydrotrope is defined generally as a substance that increases the solubility in water of another material that is only partially soluble. Within the context of this specification, a hydrotrope is a material that increases the solubility of component (C) as defined above in water, and more particularly in water containing substantial amounts of salts as described in component (B) above. Hydrotrope component (D) is usually preferred in the composition because the relatively large amounts of salt present in the composition might otherwise tend to reduce the solubility of non-ionic detergents to a level where the ability of the composition to remove and disperse organic soils is less than desirable. The presence of a hydrotrope, preferably an ammonium or alkali metal salt of a sulfonate of toluene, xylene, or cumene, makes possible the presence of relatively high amounts of both salt and nonionic surfactant in an aqueous solution. A concentration (g/kg) of hydrotrope equal to from one quarter to three quarters of the concentration of salt component (B) present is generally preferred. The most preferred hydrotrope is sodium cumene sulfonate.

It should be understood that the above description of a composition according to the invention is not intended to imply that there may not be chemical interactions among the components specified in the composition. The description refers to the components as added, or as reduced or increased in amount in situ by acid-base reactions, and does not exclude new chemical entities that may be formed by interaction in the composition.

Another embodiment of the invention comprises an aqueous concentrate that can be diluted with water only to produce, optionally after adjustment of pH by adding acid or base, a composition as given above ready for use as such in cleaning plastic surfaces. The term "water only" herein is intended to include water from normal domestic and industrial water supplies as well as deionized, distilled, or other specially purified water. It is normally preferred that a concentrate have a composition such that a solution of from 0.5 to 3% by weight of the concentrate in water will be suitable for direct use for cleaning plastics as described above.

A process according to this invention comprises contacting a soiled plastic surface with a suitable composition according to the invention as described above for a sufficient time at a sufficiently high temperature to achieve the desired amount of soil removal. Contacting between the surface and the liquid composition according to the invention may be accomplished by any convenient method, such as immersing the surface in a container of the liquid composition, spraying the composition on the surface, or the like, or by a mixture of methods. Any temperature between just above the freezing point and just below the boiling point of the liquid cleaning composition may generally be used, with a temperature of 40° to 70° C. generally preferred and 50°–60° C. more preferred. At these preferred temperatures, a time of contact of from 20–120 seconds is generally preferred, with from 45–75 seconds more preferred.

After cleaning as described immediately above, it is generally preferred to rinse the cleaned surface with water to remove any residue of the cleaning composition before subsequent use or surface finishing of the cleaned plastic. Most preferably, at least the last such rinse should be with deionized or other purified water. Usually, the rinsed surface should then be dried before subsequent finishing treatments. Drying also may be accomplished by any convenient method, such as a hot air oven, exposure to infra-red radiation, microwave heating, or the like.

DESCRIPTION OF PREFERRED EMBODIMENTS

As already noted above, one of the major objects of this invention is to avoid phosphate pollution. It is therefore increasingly more preferred that the compositions according to this invention contain no more than 2, 1, 0.5, 0.25, 0.1, or 0.01 percent by weight of phosphate or other phosphorus containing anions produced by the ionization of phosphoric or condensed phosphoric acids. Similarly, to avoid air pollution and fire hazards, it is increasingly more preferred that the compositions according to this invention contain no more than 2, 1, 0.5, 0.25, 0.1, or 0.01 percent by weight of organic solvents or other organic materials with a boiling point lower than that of water.

The choice of pH and total acid content of a composition according to this invention generally requires some compromise between cleaning effectiveness and corrosive effect on the metal containers and/or other metal equipment generally used in connection with the cleaning process or for storing and transporting cleaning compositions. Lower pH and higher total acidity generally are favorable to consistency of cleaning and prolong the useful life of a cleaning composition, but these characteristics of the cleaning composition also promote corrosion, particularly of mild steel equipment which is in common commercial use in contact with the cleaning compositions. In order to select the optimum composition according to this invention it is therefore necessary to consider both cleaning effectiveness and corrosion risk. This will be illustrated in connection with the examples below.

The major motive for providing a high buffer capacity in compositions according to the invention as described above is to provide substantial consistency of cleaning effect as the composition is used. This is particularly important when part of the cleaning involves removing alkaline types of soils, and also when the plastic being cleaned contains alkaline filler materials, such as the very commonly used calcium carbonate. In such cases, it eventually becomes advantageous to replenish the acid constituent of the composition as it is consumed during use.

For practical reasons that will be apparent to those skilled in the art, it is strongly preferred to choose components for cleaning compositions according to this invention that have relatively low foaming characteristics at the temperature of actual use. It has been found convenient to measure foaming potential by a test using 150 milliliters ("ml") of cleaning composition, ready for actual use in cleaning, in a glass stoppered graduated cylinder with at least 250 ml capacity. The cylinder and its contents are brought to temperature equilibrium by any convenient method, usually a controlled temperature bath, and then are vigorously shaken up and down by hand, while upright with the stopper in place, ten times in quick succession. Immediately after this shaking is completed, the cylinder is placed upright on a horizontal table and the stopper is removed. A timer is started immediately after the stopper has been removed. The foam volume is determined from the graduations on the cylinder by noting the difference between the graduations at the top of the foam and at the top of the underlying liquid composition in the cylinder at a time 15±1 seconds after the timer was started.

In general, it has been observed that most compositions according to this invention, when measured by the test described above, will have large foam volumes at normal ambient temperatures, but that the amount of foam will decrease dramatically at some temperature below that normally used and preferred for cleaning. This illustrated below in connection with the specific working examples.

It is increasingly more preferred that the foam volume, measured as described above, of a composition for cleaning according to this invention be not more than 25, 15, 5, 2, or 0.5 ml at the temperature of actual use for cleaning. If the temperature of intended use is not known, it is increasingly more preferred that the same values for foam volume not be exceeded at 60°, 54°, 43°, or 32° C.

The practice of this invention may be further appreciated from the following, non-limiting, working examples.

EXAMPLE 1

For this example, a concentrate composition according to the invention was prepared from the following ingredients ("PBW" =parts by weight) by the following procedure: 20.0 PBW of citric acid was dissolved in 250 PBW of deionized ("DI") water. An amount of 13.0 PBW of 50% by weight of aqueous sodium hydroxide solution was added to this mixture with stirring until there was a uniform appearance throughout the solution. An amount of 5.0 PBW of 60% by weight of aqueous fluotitanic acid was then added, again with stirring until there was a uniform appearance throughout the solution. To this mixture were then added in succession with stirring 200 PBW of DI water, 25 PBW of sodium cumene sulfonate (commercially available as NAXONATE TM SC from Ruetgers-Neace Chemical Co., State College, Pa.), 20.0 PBW of WITCONOL TM 1206 (a modified oxyalkylated alcohol, commercially available from Witco Corp., N.Y.), 5.0 PBW of TRITON TM X-100 (octylphenoxy polyethoxy ethanol with a Hydrophile-Lipophile Balance of 13.5, commercially available from Rohm & Haas Co., Philadelphia), 5.0 PBW of MAKON TM NF 12 (polyalkoxylate on an aliphatic base, commercially available from Stepan Co., Northfield, Ill.), and 457 PBW of DI water.

The concentrate as described immediately above was diluted with tap water to provide a 2% by weight amount of the concentrate in a composition for cleaning. This diluted composition was then adjusted with sodium hydroxide to give a pH of 5.2 and was tested for cleaning effect at 52° C. with 75 seconds spraying contact on the soils and plastic substrates shown in Table 1, with the results also shown there. (The soils shown in Table 1, which are representative of types of soil commonly encountered in an automobile manufacturing plant, were deliberately applied to the plastic test panels in a uniform manner for the purpose of these tests.)

The composition ready for cleaning use as described above was also tested for its corrosive effect on cold rolled mild steel panels 10 by 15 centimeters in size. Panels were degreased in acetone, then dried and accurately weighed. Weighed panels were sprayed for 2

TABLE 1

CLEANING RESULTS WITH COMPOSITION OF EXAMPLE 1

| | Effectiveness of Cleaning from: | | |
|---|---|---|---|
| Soil Type | PCO[1] | TPO[2] | PPO[3] |
| Mold Release Soap | Clean | Clean | Clean |
| Wax | Trace left | Part left | Clean (WB) |
| Lock lubricant | Part left | Not removed | Clean (WB) |
| Human skin oil | Clean | Clean | Clean |
| Motor oil | Clean | Not removed | Clean (WB) |

Notes for Table 1

"Clean" means that the test panel was free from any visual evidence of the type of soil indicated and free from water breaks after rinsing with water in the area of the test panel where the specified type of soil was present before cleaning, except when followed by "(WB)", which indicates that water breaks were observable even though there was no visually detectable amount of soil remaining.

[1]LEXAN TM from General Electric Co.

[2]Supplied by Republic Plastics Co.

[3]NORYL TM GTX 910 from General Electric Co.

hours with the cleaning composition at 52° C., then rinsed with DI water, dried, and again weighed accurately to determine weight loss. The average weight loss per panel on six panels was 0.27 grams, with an average deviation of 0.04 grams. When the corrosion testing was repeated, except that less NaOH was added after dilution of the concentrate so that the initial pH was 4.4, the average corrosion rate was about ten times higher. This higher corrosion rate is likely to be unacceptable, so that when using this particular embodiment of the cleaning composition according to this invention, it is important to keep the pH above 5.

The buffering capacity of this composition is sufficiently high that at least 0.10 milliequivalents of strong base per liter of the composition must be added to raise the pH of the composition by 0.1 pH unit.

EXAMPLE 2

For this example, a concentrate composition according to the invention was prepared from the following ingredients by the following procedure: 60 PBW of a 50% by weight aqueous solution of gluconic acid was dissolved in 250 PBW of deionized DI water. An amount of 11.0 PBW of 50% by weight aqueous sodium hydroxide solution was added to this mixture with stirring until there was a uniform appearance throughout the solution. To this mixture were then added in succession with stirring 205 PBW of DI water, 25 PBW of sodium cumene sulfonate, 20.0 PBW of WITCONOL TM 1206, 5.0 PBW of TRITON TM X-100, 5.0 PBW of MAKON TM NF 12, and 419 PBW of DI water.

The concentrate as described immediately above was diluted with DI water to provide a 2% by weight amount of the concentrate in a composition suitable for cleaning. This composition was tested for its corrosive effect by immersing half of each of several corrosion test panels of the same type as used in Example 1 in a container of the cleaning composition initially at 60° C. The panels remained in the cleaning composition overnight, but the temperature gradually declined to room temperature. Corrosive weight loss averaged only 0.033 grams per total panel equivalent. However, the buffering capacity of this gluconic acid containing composition is lower then the citric acid based composition of Example 1, so that it would not be expected to last nearly as long without replenishment in practical use.

EXAMPLE 3

For this example, a concentrate composition according to the invention was prepared from the following ingredients by the following procedure: 45 PBW of sodium citrate and 22 PBW of citric acid were dissolved in 660 PBW of DI water. An amount of 6.8 PBW of 50% by weight of aqueous sodium hydroxide solution was added to this mixture with stirring until there was a uniform appearance throughout the solution. To this mixture were then added in succession with stirring 27 PBW of sodium cumene sulfonate, 0.8 PBW of sodium bisulfite (added for its biocidal effect), 86.0 PBW of DF 16 TM (a modified polyethoxylated alcohol nonionic surfactant with Chemical Abstracts Registry No. 68603-25-8, commercially available from Rohm & Haas Co.), and 152.4 PBW of DI water.

To make a suitable composition for immediate use in cleaning, the concentrate described above may, for example, be diluted with tap or DI water to give a composition containing 2% by weight of the concentrate, and sufficient NaOH or citric acid added to this diluted composition to give a pH of 5.25±0.25. As this composition is used for cleaning, the pH tends to rise, and most preferably additional citric acid is added, usually from aqueous solution, as necessary to keep the pH within the specified range.

The foam volumes developed at various temperatures were measured by the method described above for a sample of a composition made by dissolving the concentrate prepared for this example in DI water to give a solution containing 2% of the concentrate by weight. The foam volumes found are shown in Table 2 below. The buffering capacity of this composition is sufficiently high that at least 0.30 milliequivalents of strong base per liter of the composition must be added to raise the pH of the composition by 0.1 pH unit.

TABLE 2

FOAM VOLUMES FOR A COMPOSITION MADE BY DILUTING A CONCENTRATE ACCORDING TO EXAMPLE 3

| Temperature, °C.: | 21 | 27 | 31 | 37 | 43 | 49 | 60 |
|---|---|---|---|---|---|---|---|
| Foam Volume, ml: | 112 | 112 | 24 | 22 | 14 | 4 | <1 |

What is claimed is:

1. An aqueous liquid composition of matter that has a pH in the range from about 4.4 —about 6.1; that has a buffering capacity sufficiently high that at least about 0.06 milliequivalents of a strong base per liter of the composition must be added to raise the pH of the composition by 0.1 pH unit; that contains a total of not more than 0.01 percent by weight of material selected from the group consisting of organic solvents and other organic materials with a boiling point lower than that of water; that has a foam volume of not more than 25 ml from 150 ml of the composition at a temperature of 60° C.; and that consists essentially of water and:

(A) from about 0.4 to about 10 milliequivalents per kilogram of total composition ("mEq/kg") of acids selected from the group consisting of hydroxycarboxylic and dicarboxylic acids;

(B) from about 1.4 to about 20 mEq/kg of salts containing anions of acids selected from the group consisting of hydroxycarboxylic and dicarboxylic acids;

(C) from about 0.21 to about 3.3 grams per kilogram of total composition ("g/kg") of nonionic surfactant; and (D) an amount of hydrotrope material that is from about 0.25 to about 0.75 times the amount in g/kg of component (C), said hydrotrope material being selected from the group consisting of the ammonium and alkali metal salts of sulfonates of toluene, xylene, and cumene and mixtures thereof; and, optionally, (E) a sufficient amount of biocidal material to inhibit growth of any bacteria and fungi that may be present in the composition.

2. A composition according to claim 1 that has a pH in the range from about 5.0 —about 5.7.

3. A composition according to claim 2 having a buffering capacity sufficiently high that at least about 0.23 milliequivalents of a strong base per liter of the composition must be added to raise the pH of the composition by 0.1 pH unit, wherein the amount of component (A) is from about 0.9 to about 6 mEq/kg; the amount of component (B) is from about 2.7 to about 19 mEq/kg; and the amount of component (C) is from about 0.4 —about 3 g/kg.

4. A composition according to claim 1 having a buffering capacity sufficiently high that at least about 0.23 milliequivalents of a strong base per liter of the composition must be added to raise the pH of the composition by 0.1 pH unit, wherein the amount of component (A) is from about 0.9 to about 6 mEq/kg; the amount of component (B) is from about 2.7 to about 19 mEq/kg; and the amount of component (C) is from about 0.4 —about 3 g/kg.

5. A composition according to claim 4, wherein the amount of component (A) is from about 1.6 to about 5 mEq/kg; the amount of component (B) is from about 5.3 to about 15.6 mEq/kg; and the amount of component (C) is from about 0.87 —about 2.6 g/kg.

6. A composition according to claim 3 wherein the amount of component (A) is from about 1.6 to about 5 mEq/kg; the amount of component (B) is from about 5.3 to about 15.6 mEq/kg; and the amount of component (C) is from about 0.87—about 2.6 g/kg.

7. A composition according to claim 6, having a foam volume of not more than 2 ml from 150 ml of the composition at a temperature of 54° C.

8. A composition according to claim 5, having a foam volume of not more than 2 ml from 150 ml of the composition at a temperature of 54° C.

9. A composition according to claim 4, having a foam volume of not more than 2 ml from 150 ml of the composition at a temperature of 54° C.

10. A composition according to claim 3, having a foam volume of not more than 2 ml from 150 ml of the composition at a temperature of 54° C.

11. A composition according to claim 2, having a foam volume of not more than 2 ml from 150 ml of the composition at a temperature of 54° C.

12. A composition according to claim 1, having a foam volume of not more than 2 ml from 150 ml of the composition at a temperature of 54° C.

13. An aqueous liquid concentrate composition of matter that can be diluted with water only to produce a diluted composition that has a buffering capacity sufficiently high that at least 0.06 milliequivalents of a strong alkali per liter of the composition must be added to raise the pH of the composition by 0.1 pH unit; that contains a total of not more than 0.01 percent by weight of material selected from the group consisting of organic solvents and other organic materials with a boiling point lower than that of water; that has a foam volume of not more than 25 ml from 150 ml of the composition at a temperature of 60° C.; and that consists essentially of water and:

(A) from about 0.4 to about 10 milliequivalents per kilogram of total composition ("mEq/kg") of acids selected from the group consisting of hydroxycarboxylic and dicarboxylic acids;

(B) from about 1.4 to about 20 mEq/kg of salts containing anions of acids selected from the group consisting of hydroxycarboxylic and dicarboxylic acids;

(C) from about 0.21 to about 3.3 grams per kilogram of total composition ("g/kg") of nonionic surfactant; and (D) an amount of hydrotrope material that is from about 0.25 to about 0.75 times the amount in g/kg of component (C), said hydrotrope material being selected from the group consisting of the ammonium and alkali metal salts of sulfonates of toluene, xylene, and cumene and mixtures thereof; and, optionally, (E) a sufficient amount of biocidal material to inhibit growth of any bacteria and fungi that may be present in the composition.

14. A process for cleaning a soiled plastic surface, said process comprising contacting the soiled plastic surface for a sufficient time to remove at least part of the soil therefrom with an aqueous liquid composition of matter that has a pH in the range from about 4.4 —about 6.1; that has a buffering capacity sufficiently high that at least 0.06 milliequivalents of a strong alkali per liter of the composition must be added to raise the pH of the composition by 0.1 pH unit; that contains a total of not more than 0.01 percent by weight of material selected from the group consisting of organic solvents and other organic materials with a boiling point lower than that of water; that has a foam volume of not more than 25 ml from 150 ml of the composition at a temperature of 60° C. and that consists essentially of water and:

(A) from about 0.4 to about 10 milliequivalents per kilogram of total composition ("mEq/kg") of acids selected from the group consisting of hydroxycarboxylic and dicarboxylic acids;

(B) from about 1.4 to about 20 mEq/kg of salts containing anions of acids selected from the group consisting of hydroxycarboxylic and dicarboxylic acids;

(C) from about 0.21 to about 3.3 grams per kilogram of total composition ("g/kg") of nonionic surfactant; and (D) an amount of hydrotrope material that is from about 0.25 to about 0.75 times the amount in g/kg of component (C), said hydrotrope material being selected from the group consisting of the ammonium and alkali metal salts of sulfonates of toluene, xylene, and cumene and mixtures thereof; and, optionally, (E) a sufficient amount of biocidal material to inhibit growth of any bacteria and fungi that may be present in the composition.

* * * * *